US010724837B2

(12) United States Patent
Hall

(10) Patent No.: US 10,724,837 B2
(45) Date of Patent: Jul. 28, 2020

(54) BREECH PLUG FOR A PRELOADED FIREARM SYSTEM

(71) Applicant: Ardesa, S.A., Zamudio-Vizcaya (ES)

(72) Inventor: Thomas F. Hall, Higganum, CT (US)

(73) Assignee: Ardesa, S.A., Zamudio-Vizcaya (ES)

( * ) Notice: Subject to any disclaimer, the term of this patent is extended or adjusted under 35 U.S.C. 154(b) by 74 days.

(21) Appl. No.: 15/723,595

(22) Filed: Oct. 3, 2017

(65) Prior Publication Data

US 2018/0100727 A1 Apr. 12, 2018

Related U.S. Application Data

(60) Provisional application No. 62/404,881, filed on Oct. 6, 2016.

(51) Int. Cl.

| | |
|---|---|
| ***F41C 9/08*** | (2006.01) |
| ***F42B 14/08*** | (2006.01) |
| ***F42B 14/06*** | (2006.01) |
| ***F42B 5/067*** | (2006.01) |
| ***F42B 5/10*** | (2006.01) |
| ***F42B 5/18*** | (2006.01) |

(52) U.S. Cl.

CPC ..... *F42B 14/08* (2013.01); *F41C 9/08* (2013.01); *F42B 5/067* (2013.01); *F42B 5/105* (2013.01); *F42B 5/18* (2013.01); *F42B 14/064* (2013.01)

(58) Field of Classification Search

CPC ..... F42B 14/08

See application file for complete search history.

(56) References Cited

U.S. PATENT DOCUMENTS

| | | | | |
|---|---|---|---|---|
| 6,219,951 | B1 * | 4/2001 | Cate | F41C 9/08 42/51 |
| 6,226,916 | B1 * | 5/2001 | Kendall | F41C 9/08 42/51 |
| 7,726,245 | B2 * | 6/2010 | Quesenberry | F42B 5/067 102/432 |
| 2005/0193615 | A1 * | 9/2005 | Hengstenberg | F41A 21/12 42/51 |
| 2010/0024272 | A1 * | 2/2010 | Laney | F41A 3/18 42/51 |
| 2014/0090285 | A1 | 4/2014 | Peterson et al. | |

FOREIGN PATENT DOCUMENTS

| | | | |
|---|---|---|---|
| GB | 9043 | * | 4/1910 |

* cited by examiner

*Primary Examiner* — Stephen Johnson

(74) *Attorney, Agent, or Firm* — DeLio Peterson & Curcio LLC; Robert Curcio

(57) ABSTRACT

A sabot having an extended casing for containing propellant charge and a slotted top portion for securing a projectile. The propellant charge is ignited by gases that enter the lower portion of the sabot from a puncture developed by the mating of the sabot against a breech plug. The breech plug has a piercing component in the form of a sharpened forward edge to initiate puncture of the breech end of the sabot.

12 Claims, 7 Drawing Sheets

BREECH PLUG FOR A PRELOADED FIREARM SYSTEM

CROSS-REFERENCE TO RELATED APPLICATION

This application claims the benefit of U.S. Provisional Application No. 62/404,881, filed Oct. 6, 2016.

BACKGROUND OF THE INVENTION

Field of the Invention

This invention relates generally to a sabot and breech plug system particularly for muzzleloading firearms, but may also be applied to non-muzzleloading firearms, and more particularly to a sabot having an extended casing for containing propellant and a slotted top portion for securing a bullet. The propellant is ignited by gases that enter the lower portion of the sabot from a puncture developed by the insertion of a breech plug having a sharpened forward edge for breaking the breech end of the sabot, which is designed to be vulnerable to puncture.

2. DESCRIPTION OF RELATED ART

It is well known in the field of ballistics that when a projectile passes through a gun bore at high speed, the friction between the projectile jacket and the barrel generates a considerable amount of heat. This friction causes barrel erosion or barrel wear which results in ineffective gas sealing, which further results in considerable loss of projectile velocity, eventually leading to unreliable and inconsistent flight of the projectile.

Sabots were introduced as a way to mitigate these issues. The trend in muzzleloading has been the introduction of an undersized bullet within a polymer sabot in a barrel sized for a larger caliber bullet. The undersized bullet body has a higher muzzle velocity than the larger caliber bullet providing improved ballistic characteristics.

The sabot is sized to approximate the inner diameter of the barrel such that the sabot tightly seals against the barrel to efficiently propel the bullet and engage the rifling of the barrel to impart spin to the bullet. A sabot is used on a projectile fired from a firearm, such as a bullet or shell, to ensure the correct positioning of the bullet or shell in the barrel of a gun. The sabot is generally attached either to the projectile or inside the barrel, and is designed to fall away as the projectile leaves the firearm muzzle. Essentially, there is a limit to what an unjacketed bullet can endure without stripping from the rifling of the barrel, and for that matter, what a jacketed bullet can take as well.

A sabot is a sleeve that holds the bullet during discharge while simultaneously ensuring a gas seal. It keeps a subcaliber flight projectile, such as a relatively small bullet or arrow-type projectile, in the center of the barrel when fired while simultaneously trapping propellant gas behind the projectile. The sabot is necessary because efficient aerodynamic design of a flight projectile does not always accommodate efficient interior ballistic design to achieve high muzzle velocity.

The ammunition used in muzzle loaded rifles has evolved from a projectile that is a round ball compressed in the muzzle end with a patch, to projectiles that have incorporated features of modern bullets. Within the latter category, bullet shaped projectiles can be further subdivided into those that are fired with a sabot (which replaces the patch), and projectiles that are lubricated slugs. Generally, a sabot is an encasing thermo-plastic cup that generally falls away from the projectile after it exits the gun. The sabot further eliminates the need for a lubricating means and assures that there is a good seal between the projectile and the bore of the barrel.

Sabots may also be molded directly on to a projectile. Saboted bullets are used to form a strong seal that traps propellants behind the projectile, and keep the projectile centered in the barrel. When a saboted projectile is fired, the sabot blocks the gas, and carries the projectile down the barrel. The sabot is also is acted upon by the grooves of the rifling. Sabots come in many forms, including a cup sabot, which supports the base and rear end of a projectile, and an expanding cup sabot, which upon firing uses the inertia from the rotation of the projectile to open up side sabot segments surrounding the projectile and release it. Other sabots are also available in the art, such as base sabots, spindle sabots, and ring sabots. A base sabot has a one piece base which supports the bottom of the projectile, and separate pieces that surround the sides of the projectile and center it. A spindle sabot uses at least two matched longitudinal rings which have a center section in contact with a long arrow-type projectile; a front section which centers that projectile in the barrel and provides an air scoop to assist in sabot separation upon muzzle exit, and a rear section which both centers the projectile and seals propellant gases with a ring around the outside diameter. A ring sabot uses the rear fins on a long rod projectile to help center the projectile and ride the bore, and the multi-petal sabot forms only a single bulkhead ring around the projectile near the front, and seals gases from escaping past it.

It is well known in the art that loading a traditional black powder muzzleloader firearm generally involves a certain amount of complexity (as compared to the loading of modern firearms). For loose, granular powder such general steps include: a) making sure the rifle is not primed; b) making sure the rifle bore is clean of fouling and oil; c) setting a powder measure for a desired powder charge; d) pouring the powder into the measure and then into the muzzle of the rifle; and e) using a ramrod, pressing the bullet, such as a patched round ball, past the rifling and down the bore until it contacts the powder charge.

The measurement of the powder (propellant) is not an exact science, and tends to introduce inaccuracies and inconsistencies in firing. A predetermined load provides for the user a way to eliminate some of the inaccuracies and inconsistencies, especially during field loading.

Saboted bullets are popular with muzzleloading firearms because they simplify the loading process. They generally yield higher velocities and flatter trajectories. However, it is always an art for the muzzleloader aficionado to find just the right combination of specific powder, charge, sabot, bullet, and primer to use.

SUMMARY OF THE INVENTION

Without limiting the scope of the invention, a brief summary of some of the claimed embodiments of the invention is set forth below. Additional details of the summarized embodiments of the invention and/or additional embodiments of the invention may be found in the Description of the Preferred Embodiments below.

Bearing in mind the problems and deficiencies of the prior art, it is an object of the present invention to provide a preloaded sabot bullet for use in a muzzleloader.

It is another object of the present invention to provide a sabot having the ability to contain propellant while simultaneously securing a bullet at the sabot's forward end, and being responsive to a breech plug adapted for use with the sabot of the present invention at the sabot's breech end.

It is yet another object of the present invention to provide a breech plug for working in combination with a preloaded sabot.

The present invention is directed to, in a first aspect, a preloaded sabot ammunition comprising: a sabot having a closed breech end, an open muzzle end, and a substantially cylindrical body extending from the closed breech end to the open muzzle end, the cylindrical body having an outside diameter complementary to an inside diameter of a bore of a firearm barrel, and an internal cavity; a propellant charge inserted within the internal cavity of the cylindrical body from the open muzzle end of the sabot, the propellant charge having a top end exposed to the open muzzle end of the sabot upon insertion; a projectile slideably inserted with the sabot open muzzle end proximate the top end of the propellant charge, and held by the sabot.

The closed breech end of the sabot has a thickness less than sidewalls of the cylindrical body, such that the closed breech end of the sabot is vulnerable to puncture by a breech plug fixed in a breech end of the barrel.

The cylindrical body forms a plurality of pedals, defined by a plurality of slots, extending axially from the open muzzle end of the sabot and terminating at a position intermediate the closed breech end of the sabot, the intermediate position allowing the plurality of pedals to extend to, but not below, the top end of the propellant charge when the propellant charge is fully inserted within the sabot. The cylindrical body may include a structural demarcation into the internal cavity separating the plurality of pedals from a portion of the internal cavity housing the propellant charge. The structural demarcation may comprise a circumferential lip extending radially inwards into the internal cavity.

A cap securable to the structural demarcation may be employed, the cap securing the propellant charge within the internal cavity. The cap may include a circumferential groove for mating with the circumferential lip extending radially inwards into the internal cavity.

The propellant charge comprises free or pre-packaged granular black powder, such that in any pre-packaged form, a package containing the granular powder is vulnerable to puncture by a breech plug fixed in the breech end of the barrel.

In a second aspect, the present invention is direct to a muzzleloading ammunition comprising: a sabot having an open end and a closed end, and an extended hollow body therebetween, the extended body being substantially cylindrical with a radially facing interior surface, the sabot closed end being vulnerable to puncture by a breech plug fixed in a breech end of a firearm barrel; an extended body lip or extended body groove circumferentially situated within the extended hollow body on the radially facing interior surface, placed intermediate the open end and the closed end of the sabot; a propellant charge inserted within the extended hollow body from the open end of the sabot and below the extended body lip or extended body groove; a cap inserted into the open end of the sabot, having a complementary cap groove or cap lip for interlocking with the extended body lip or extended body groove, respectively, and sealing the propellant charge a distance from the open end of the sabot; and a projectile inserted into the open end of the sabot and situated proximate the cap, such that the projectile extends approximately to or above the open end of the sabot.

The ammunition includes a plurality of resilient pedals defined by slots, extending axially from the open end of the sabot to a position above the extended body lip or extended body groove, the plurality of resilient pedals securing the projectile to the sabot.

The extended hollow body includes a radially facing exterior surface having a diameter complementary to the inside diameter of a bore of a muzzleloader firearm used to fire the muzzleloading ammunition.

In a third aspect, the present invention is directed to a breech plug for a muzzleloader firearm, the breech plug adapted for use with ammunition having a preloaded sabot, the breech plug comprising: a cylindrical body extending from a first end to a second end along an axial or longitudinal axis, the cylindrical body including a threaded, or tightly coupled connection for removable installation with a corresponding complementary connection at a breech end of a barrel of the muzzleloader; a nose portion at a muzzle end of the breech plug; a cavity or pocket at a breech end of the breech plug for receiving a primer cap; an internal passage for transporting gas from the primer cap into the barrel through the nose portion of the breech plug, upon firing of the muzzleloader firearm; the nose portion having a piercing component for puncturing the preloaded sabot upon final placement of the preloaded sabot into the barrel, such that when the muzzleloader firearm is fired, hot gas from the primer cap is transported through the breech plug, into the punctured preloaded sabot, where a propellant charge is ignited.

The piercing component may comprise a sharp edged wedge shaped structure for puncturing the preloaded sabot, the wedge shaped structure having a portion of the internal passage passing therethrough.

The piercing component may comprise a pin-shaped structure for puncturing the preloaded sabot, the pin-shaped structure having a portion of the internal passage passing therethrough.

The piercing component may include a cup-shaped structure extending in a direction of the barrel muzzle end, the cup-shaped structure having narrow or sharp edges at a periphery for piercing the preloaded sabot, the cap-shaped structure having a portion of the internal passage passing therethrough.

In a fourth aspect, the present invention is directed to a preloaded sabot ammunition system comprising: a sabot including: a closed breech end, an open muzzle end, and a substantially cylindrical body extending from the closed breech end to the open muzzle end, and an internal cavity within the cylindrical body, the cylindrical body having an outside diameter complementary to an inside diameter of a bore of a breech end of a firearm barrel; a propellant charge insertable within the internal cavity of the cylindrical body from the open muzzle end of the sabot, the propellant charge having a top end exposed to the open muzzle end of the sabot upon insertion; a projectile slideably inserted within the sabot open muzzle end proximate the top end of the propellant charge, and held by the sabot; and a breech plug including: a cylindrical body extending from a first end to a second end along a longitudinal axis, the cylindrical body including a threaded, or tightly coupled, connection for removable installation with a corresponding complementary connection at a breech end of a barrel of the firearm; a nose portion at a muzzle end of the breech plug; a cavity or pocket at a breech end of the breech plug for receiving a primer cap; an internal borehole for transporting gas from the primer cap into the barrel through the nose portion of the breech plug, upon firing of the firearm; the nose portion having a protrusion for puncturing or piercing the sabot upon placement of the sabot into the breech end of the barrel, such that when the firearm is fired, hot gas from the primer cap is transported through the breech plug, into the punctured or pierced sabot, igniting the propellant charge.

In a fifth aspect, the present invention is directed to a method of loading a muzzleloader firearm comprising: attaching a breech plug to a breech end of a barrel of the muzzleloader firearm, the breech plug having a piercing component at an end facing the breech end of the barrel; loading a preloaded sabot ammunition into the muzzle end of the barrel of the muzzleloader firearm, and seating the preloaded sabot ammunition at the breech end of the barrel; piercing the preloaded sabot ammunition with the piercing component of the breech plug.

The piercing of the preloaded sabot ammunition preferably occurs during the seating of the ammunition.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIGS. 3A-3D are a cross-sectional views of a preloaded sabot of FIG. 2, wherein, FIG. 3A depicts a barrel with rifling which acts upon sabot during firing; FIG. 3B is an exploded view of the thin-walled portion of breech end of the sabot of FIG. 2; FIG. 3C depicts an exploded view of a cap inserted into the top portion of the sabot of FIG. 2; and FIG. 3D depicts the preloaded sabot in its assembled state;

DESCRIPTION OF THE PREFERRED EMBODIMENT(S)

In describing the preferred embodiment of the present invention, reference will be made herein to FIGS. 1-6 of the drawings in which like numerals refer to like features of the invention.

Figure 1:
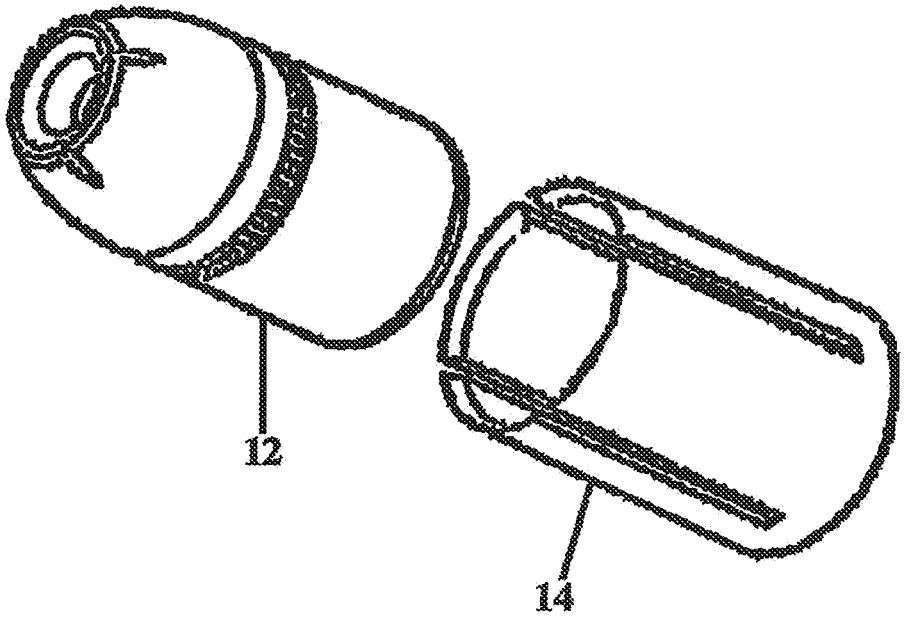
FIG. 1 is a perspective, exploded view of a bullet and sabot as typically presented in the prior art.

The current state of the art of saboted bullets is depicted in FIG. 1, which is an exploded view of a bullet or projectile 12 and accompanying sabot 14. The sabot 14 is slideably attached to the bullet or projectile 12. The sabot 14 includes a bottom end, and split sides that circumferentially engulf the lower portion of the bullet or projectile 12.

The bullet or projectile 12, shown in FIG. 1, is generally a cone-tipped cylindrical bullet. The split sabot leaves or pedals surround the projectile and ensure the correct positioning of the projectile in the barrel of the firearm. The sabot is generally attached either to the projectile or inside the barrel and falls away as it leaves the firearm muzzle. The sabot is typically used in the bore of a muzzle loader having lands and grooves that are helically positioned along the length of the barrel. The sabot is able to engage the grooves to rotate the bullet upon discharge.

Propellant charge, generally in the form of tamped black powder, is placed in the barrel of a muzzleloader firearm at the breech end prior to the placement of the saboted bullet. The sabot-shrouded bullet is then placed in the muzzle end of the firearm barrel and pushed into place by a ramrod. Upon firing of the muzzleloader firearm, the propellant is acted upon by ignited gas delivered through a breech plug, which it in turn causes abundant propellant gas that forces the saboted bullet out of the barrel.

The breech plug is removably attached to the barrel. The breech plug includes a central passage 48 (flash channel/fire channel) that communicates between a primer, a capillary tube 44, and the flash hole. The central passage 48 terminates at a primer pocket or cavity at the breech end of the breech plug. The primer pocket has a diameter greater than the central passage.

One preferred embodiment of the present invention is directed to a muzzle loaded ammunition round. In this embodiment, unlike the prior art, and genuinely unique to firearms, particularly muzzleloader firearms, a saboted bullet is presented where the bullet and propellant charge are both encompassed by the sabot. That is, the propellant charge is contained within an extended lower portion of the sabot cylindrical body or casing of the sabot, while the upper portion of the sabot secures the bullet. In this manner, the sabot is introduced as a "preloaded" component.

In a preferred embodiment, the sabot has a closed breech end, an open muzzle end, and a substantially cylindrical body extending from the closed breech end to the open muzzle end. That is, the sabot is closed at one end and open at the other, such that upon insertion into the barrel of the firearm, the closed end is proximate the breech end of the firearm, and the open end is proximate the muzzle end of the firearm. The sabot's cylindrical body has an outside diameter complementary to an inside diameter of the bore of the firearm barrel, and an internal cavity;

A propellant charge is inserted within the internal cavity of the cylindrical body from the open muzzle end of the sabot; the propellant charge includes a top end exposed to the open muzzle end of the sabot upon insertion.

A projectile may then be slideably inserted with the sabot open muzzle end proximate the top end of the propellant charge, and held by the sabot. In this manner, the preferred embodiment of the preloaded sabot has the configuration as delineated in FIG. 3D.

Figure 2:
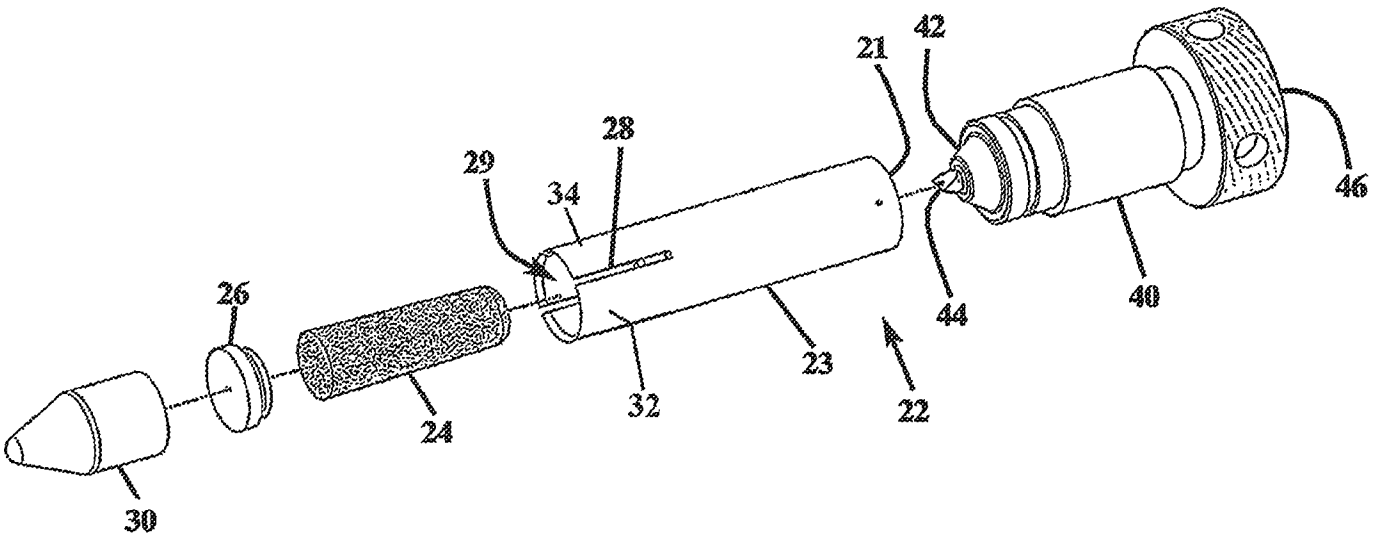
FIG. 2 depicts an exploded view of an embodiment of the preloaded sabot system.

FIG. 2 depicts an exploded view of an embodiment of the preloaded sabot. Sabot 22 is loaded with propellant charge 24, such as granular black powder or a black powder substitute, e.g., Pyrodex®, or other deflagrating powders. Cap 26, is pressed or screwed in place to secure the propellant within the sabot. It is possible for the projectile to form sealing for the propellant charge 24, rather than cap 26; however, a separate cap is a more efficient gas containment structure than the projectile itself.

The propellant charge 24 is contained within sabot 22 below the breech end of slots 28, which are formed by the leaves or pedals 32, 34 of the muzzle end of the sabot, so that propellant charge 24 and subsequent gases formed by ignition cannot escape through the slots 28. Projectile or bullet 30 is press fitted on top of cap 26 so that the slotted top portion of sabot 22 forms a projectile receiving chamber 29, which in turn releases projectile 30 upon exiting the barrel.

The sabot can be constructed at least in part out of a resilient thermoplastic material. In the embodiment depicted by FIG. 2, the sabot 22, cap 26, and propellant charge 24 form the ammunition or cartridge of the preloaded sabot system. Upon loading projectile 30 into the muzzle end of sabot 22, the slotted leaves or pedals 32, 34 of sabot 22 surround and engage projectile 30, securing its position.

When propellant charge 24 is ignited it burns very rapidly, combustion gases being formed in the cartridge chamber which produce an enormously high pressure. Owing to the locking of the firearm at the breech of the barrel, and the sealing at that end by the breech plug, these combustion gases cannot stream backwards but they exert instead a pressure on the sabot 22 and the projectile 30, which initiates a forward thrust on the projectile 30, launching the saboted projectile through the bore of the barrel under increasing acceleration.

The breech end 21 of sabot 22 is preferably made of the same material as the outer casing portion 23, and preferably thinner in construction. Although, depending upon the sabot material, it may be possible for the breech end to be of the same thickness as the sabot casing provided, as discussed below, the breech end of the sabot is capable of being punctured by a complementary breech plug. This thinner, or "puncture vulnerable" area of the sabot is acted upon by a uniquely shaped breech plug 40 having a forward end 42 capable of puncturing the breech end 21 of sabot 22. Preferably, breech plug 40 includes a sharp edged wedge shaped extension or pin-shaped extension or other "piercing" design, capable of puncturing the thin-walled or puncture vulnerable area of breech end 21 of sabot 22.

Figure 4A:
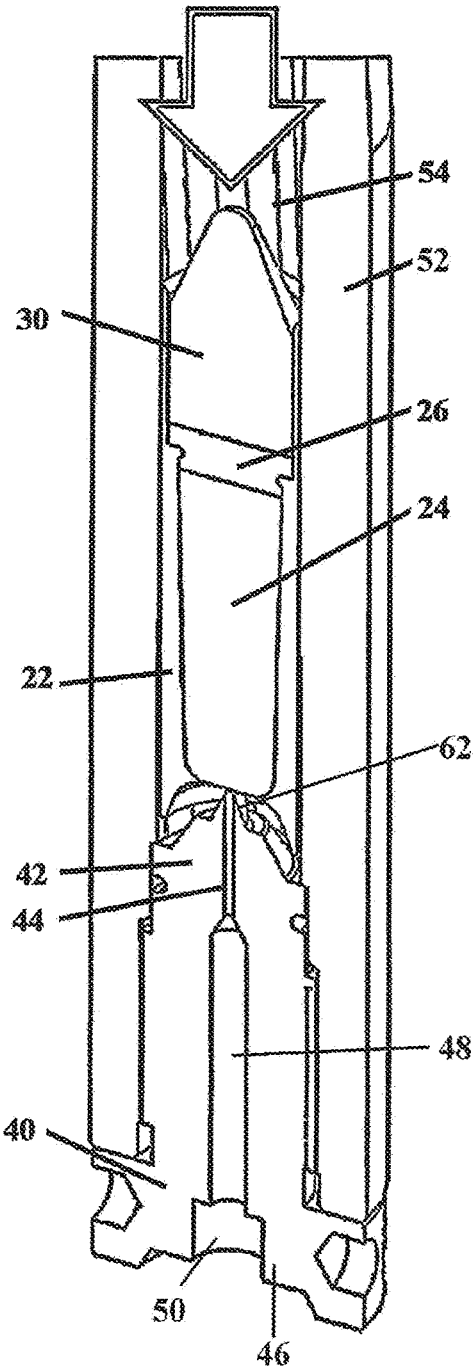
FIG. 4A depicts the preloaded sabot system within the breech end of a barrel at the point of puncturing by the forward end of the breech plug.

Breech plug 40 is specifically designed for the preloaded sabot system of the present invention, insomuch as breech plug 40 has at least one feature at its muzzle-facing end for puncturing the breech end of the sabot. Breech plug 40 is removable from the breech end of the barrel. In a preferred embodiment, breech plug 40 includes a central passage or flash channel 48 extending therethrough, and ending in a center axial capillary tube 44 for gas egress out the breech plug's muzzle end from a flash hole, as depicted in FIGS. 4A & B. The center axial capillary tube 44 extends from the nose-end 42 of breech plug 40, through the cylindrically shaped central passage 48 in the center body portion of the breech plug, to a primer cap connection structure, such as primer pocket or cavity 50, in the breech end 46 of breech plug 40, where a primer cap (not shown) is generally placed. Breech plug 40 includes at the nose end 42, a piercing component 62, which may be, for exemplary purposes, a sharp edged wedge shaped protrusion, or pin-shaped tip or protrusion.

Figure 6A:
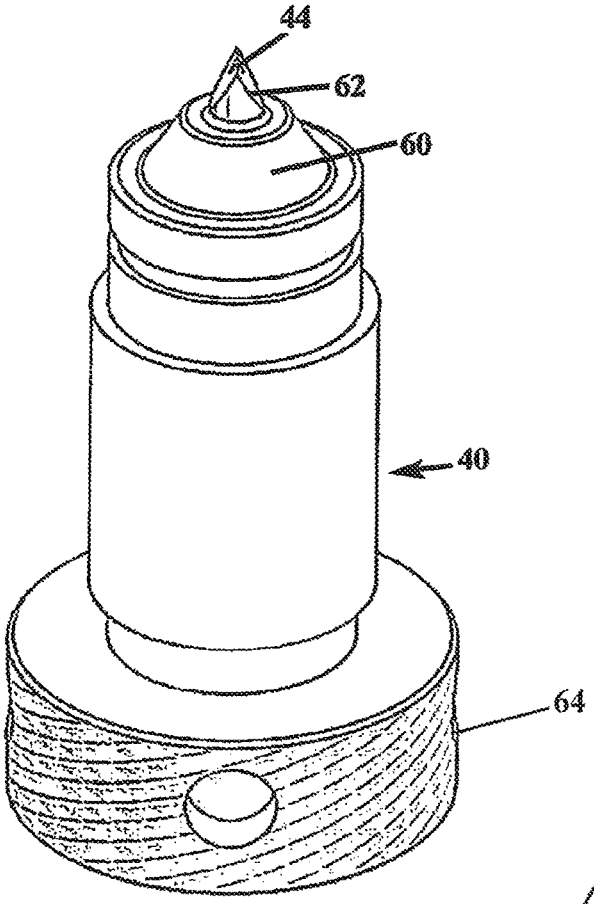
FIG. 6A is a perspective view of the breech plug designed to work with a preloaded sabot system.
Figure 6B:
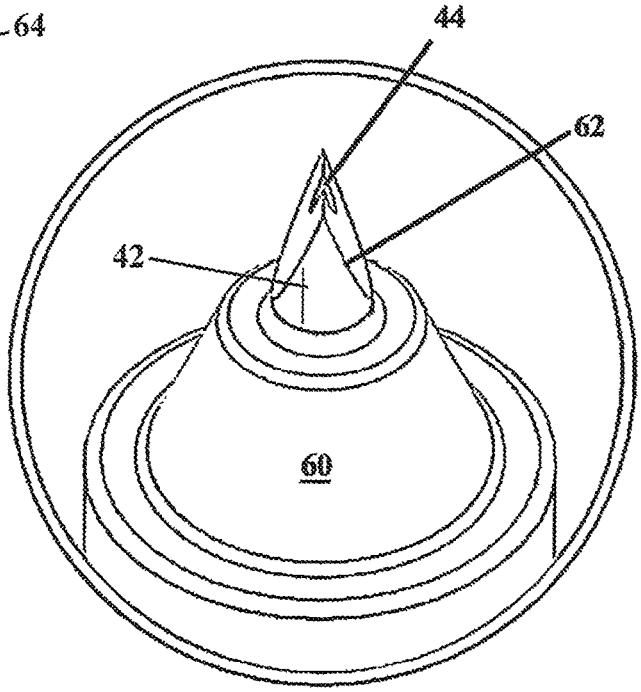
FIG. 6B depicts and exploded view of the forward end of the breech plug of FIG. 6A.
Figure 6C:
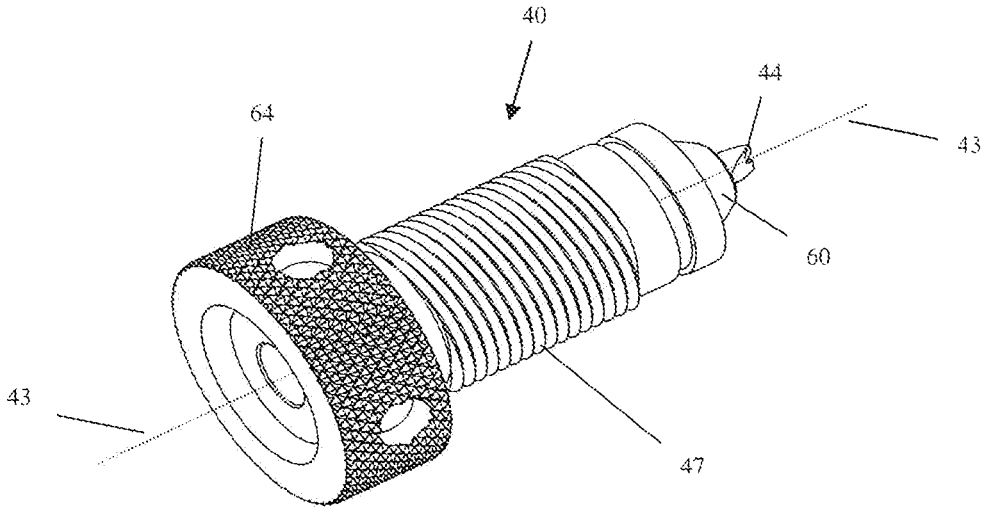
FIG. 6C is a perspective view of the breech plug of FIG. 6A depicted with a threaded body portion or connection.

FIG. 6C is a perspective view of the breech plug of FIG. 6A with a threaded body portion or connection 47. As depicted in FIG. 6C, breech plug 40 for a muzzleloader firearm is adapted for use with a preloaded sabot 22. The breech plug cylindrical body extends from a first end (a breech end) to a second end (a muzzle end) along a longitudinal axis 43; the cylindrical body includes a threaded, or tightly coupled, connection 47 for removable installation with a corresponding complementary connection at the breech end of a barrel of the muzzleloader. The breech plug nose portion is formed for puncturing the bottom or breech end portion of a preloaded sabot. The nose portion has a piercing component—a sharp protrusion for puncturing the preloaded sabot upon placement of the preloaded sabot into the breech end of the barrel, such that when the muzzleloader firearm is fired, hot gas from the primer cap is transported through the breech plug, into the punctured preloaded sabot, where a propellant charge is ignited.

Upon insertion of the ammunition, which comprises a combination of sabot 22, propellant charge 24 inserted within the sabot, an (optional) cap 26 to seal the propellant charge 24, and projectile 30 encased by the sabot pedals 32, 34, into the muzzle end of the barrel towards breech plug 40, the puncture vulnerable breech end 21 of sabot 22 is pierced by a piercing component 62, which is shown in the figures, for exemplary purposes only, as a sharp edged wedge shaped protrusion extending from the forward or muzzle end 42 of breech plug 40. Gasses developed by the activation or firing of a primer cap at the breech end of breech plug 40 traverse through central passage 48 to capillary tube 44 and its associated flash hole, through the pierced interface at the breech end 21 of sabot 22, which ultimately ignites propellant charge 24 to act upon the sabot encased projectile 30.

Typically, by the time projectile 30 has reached the muzzle end of the barrel, propellant charge 24 has been completely burnt up, and the projectile reaches its highest level of acceleration. The sabot assists in sealing the gases behind the projectile in order to maximize the acceleration of the projectile leaving the barrel.

FIGS. 3A-3D depict cross-sectional views of a preloaded sabot of the aforementioned embodiment of the present invention.

Figure 3A:
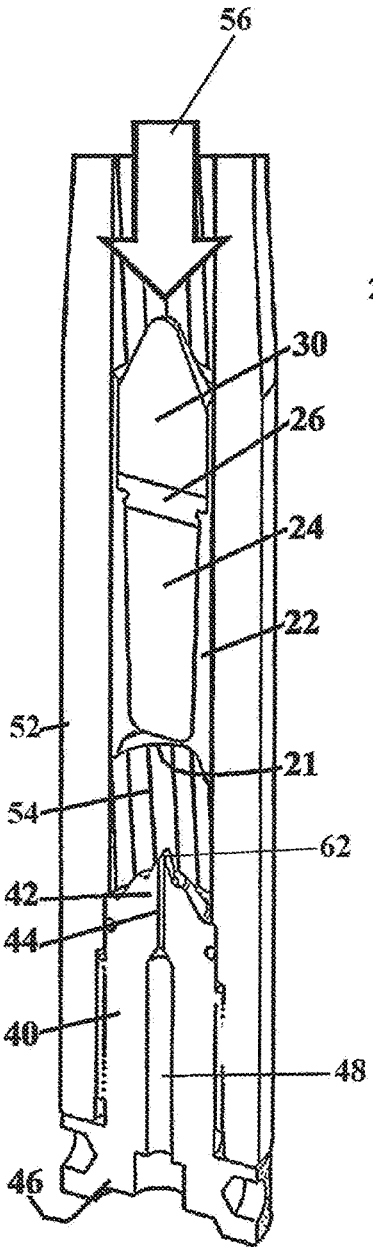

In FIG. 3A barrel 52 is depicted with rifling 54 which acts upon sabot 22 during firing. Breech plug 40 is inserted into the breech end of barrel 52, which is typically performed by a threaded coupling, although other breech plug attachment schemes known in the art may be employed. Arrow 56 depicts the direction of force of the preloaded sabot through the muzzle end of barrel 52 towards breech plug 40. Forward end 42 of breech plug 40 includes piercing component 62, here shown in the form of a sharp-edged wedge shaped protrusion which punctures the thin-walled portion of breech end 21 of sabot 22. The breech end 46 of breech plug 40 receives the primer cap.

Figure 3B:
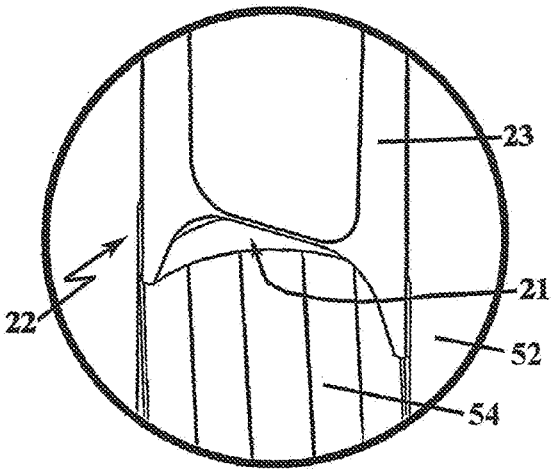

FIG. 3B is an exploded view of the thin-walled portion of breech end 21 of sabot 22. The thin-walled portion of breech end 21 of sabot 22 along with sabot wall casing 23 are designed to hold propellant charge 24 in place, preferably sealed within the sabot by cap 26. The thin-walled portion is punctured upon contact with piercing component 62 (the sharp edged wedge shaped protrusion) extending from the breech plug front end 42. As depicted, the thin-walled portion of breech end 21 of sabot 22 may be cup-shaped to entrap further the gases generated by the activation of the propellant charge.

Figure 3C:
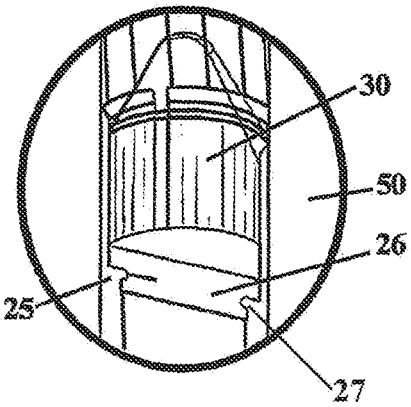

FIG. 3C depicts an exploded view of cap 26 inserted into the top portion of sabot 22. In this embodiment, cap 26 and sabot 22 are formed of resilient material to allow for at least minor flexibility. In one embodiment, cap 26 includes an annular groove 27 that mates with a complementary lip 25 extending radially inwards from the sabot casing proximate the forward end of sabot 22. In this manner, cap 26 may be press-fitted into sabot 22 after propellant charge 24 is inserted into sabot 22. The interlocking lip 25 of the sabot into annular groove 27 of the cap 26 forms a seal to retain the propellant within the sabot casing. In at least one embodiment, the seal formed by the cap 26 and lib 25 is a gas-tight seal. Although an annular groove and lip attachment scheme is depicted for the cap/sabot casing interface, it is generally understood that other attachment schemes for cap 26 may be employed. For example, cap 26 may be threaded to mate with a complementary thread on the inner surface of the sabot casing. Additionally, cap 26 may include a plurality of downward or breech facing pegs for insertion into reciprocal apertures located on the top surface of lip 25.

In addition, propellant charge 24 may be separately packaged such that a cap is not required to hold or seal the propellant in place. In this manner, in a prepackaged design, the extension of lip 25 into the cylindrical cavity of sabot 22 may be sufficient to hold the packaged propellant from falling out of sabot 22 prior to the insertion of projectile 30.

Figure 3D:
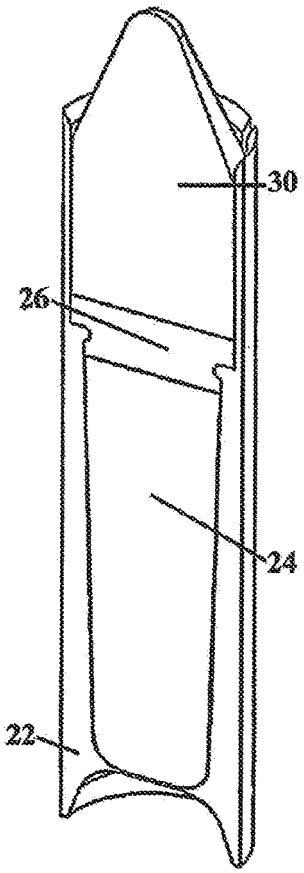

FIG. 3D depicts the ammunition of the present invention in the form of a preloaded sabot system in its assembled state.

FIG. 4A depicts the preloaded sabot system within the breech end of a barrel at the point of puncturing (but before puncturing) by piercing component 62, which is depicted as a sharp edged wedge shaped protrusion of the forward nose end 42 of breech plug 40.

Figure 4B:
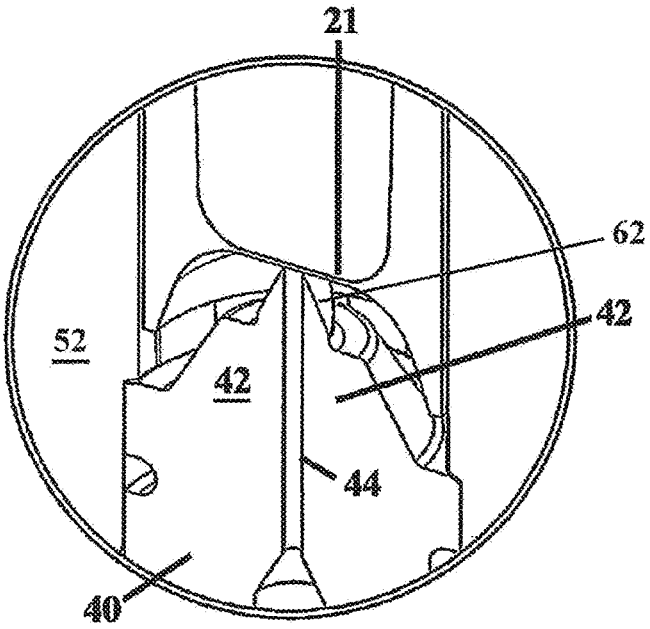
FIG. 4B is an exploded view of the contact of the forward end of the breech plug against the thin-walled portion at the breech end of sabot just prior to puncture.

FIG. 4B is an exploded view of at the point of contact of forward end 42 of breech plug 40 with sharp edged wedge shaped protrusion 62 abutting, but not puncturing, the thin-walled portion at the breech end 21 of sabot 22.

Figure 5A:
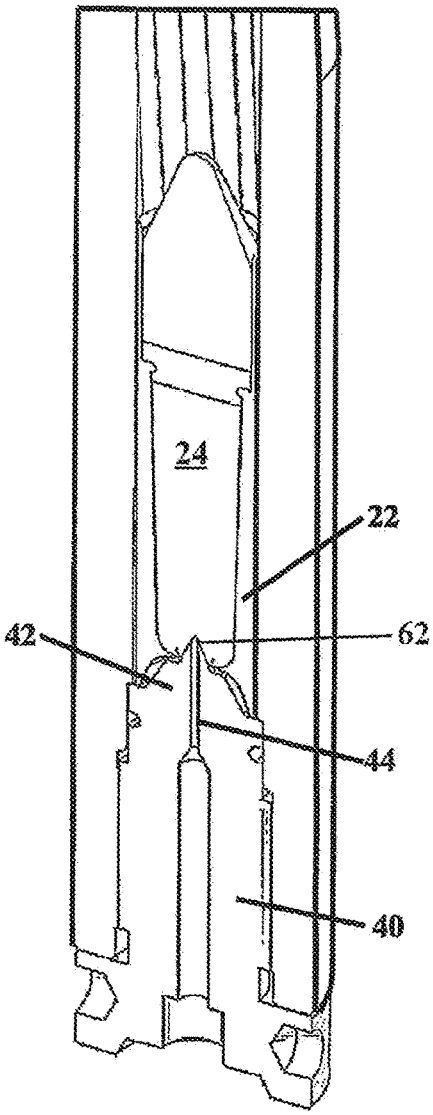
FIG. 5A depicts the preloaded sabot system within a barrel, where the forward end of breech plug has punctured the thin-walled portion of the breech end of sabot.

FIG. 5A depicts the preloaded sabot system within a barrel, where the piercing component 62 of breech plug 40 has punctured the thin-walled portion of the breech end 21 of sabot 22.

Figure 5B:
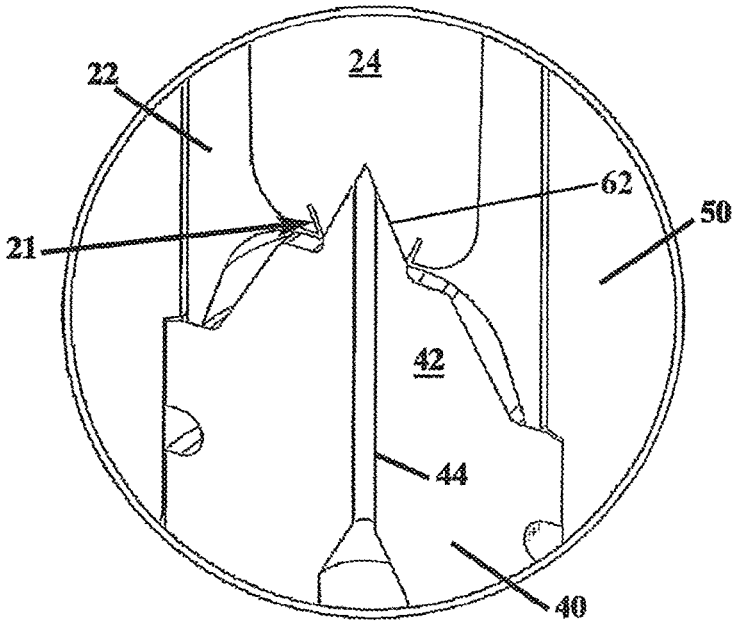
FIG. 5B is an exploded view of the punctured configuration of FIG. 5A.

FIG. 5B is an exploded view of this punctured configuration when the preloaded sabot system is inserted within barrel 52 to a depth where the piercing component 62, shown as a sharp edged wedge shaped protrusion, extends within the cavity of sabot 22 holding propellant charge 24.

FIG. 6A is a perspective view of breech plug 40 of the present invention designed to work with a preloaded sabot system. A portion of the breech plug that interfaces with, and connects to, the barrel breech end may be designed as any other breech plug used in a non-preloaded sabot system having, for example, a coarsely textured gripping disc portion 64, which allows a user to insert and fix the breech plug into the barrel. The breech plug 40 is generally cylindrical, having a cylindrical body extending from a first end to a second end along an axial or longitudinal axis. The cylindrical body includes a threaded or tightly coupled connection for removable installation with a corresponding complementary connection at a breech end of a barrel of the muzzleloader. Generally, the breech plug is threaded for securing it to the barrel in a substantially gas-sealed fit.

As depicted in FIG. 6B, the forward end 42 in this exemplary embodiment has a conical projection 60 which includes the piercing component, shown for exemplary purposes, as a sharp edged wedge shaped protrusion. The sharp edged, wedge shaped protrusion is sufficiently sharp enough to puncture the thin-walled breech end 21 of sabot 22 when the sabot system is manually inserted into the barrel of a muzzleloader firearm. In an alternative embodiment, the shape of the piercing component 62 may be significantly pointed, and resemble more of a cylindrical hollow pin-like protrusion rather than a shape edged wedge. Piercing component 62 is preferably formed as part of, integral with, the nose end 42 of breech plug 40, but it may also be an attachment to the nose end of the breech plug. The shape of piercing component 62 must be capable of puncturing the thin-walled breech end 21 of sabot 22. Some breech plugs currently have cup-shaped ends to entrap gases. In yet another alternative embodiment of the piercing component, the circumferential edge of the cup-shaped end may be sharpened to pierce the thin-walled breech end 21 of the sabot. In this manner, the muzzle-facing end of the breech plug comprises a shaped structure capable of puncturing the bottom end of the sabot.

As depicted in the figures, capillary tube 44 is shown exiting the nose end of the breech plug 42 to deliver the gasses of the primer, which is activated via a primer cap within cavity 50 at the breech end of the breech plug during firing.

In a preferred embodiment, a preloaded sabot system is configured; however, it should be understood that the preloaded sabot, inclusive of a projectile at one end, need not be used solely for a muzzleloading firearm, insomuch as the thin-walled portion of the sabot breech end may be punctured by means other than a breech plug, which allows the preloaded sabot to be used with non-muzzleloading firearms. Furthermore, a preloaded sabot, without an inserted projectile, may be easily constructed and made commercially available for different types of projectiles, which can be inserted by the user prior to loading.

In another aspect of the present invention, a method of firing a firearm is taught, in a first embodiment being a muzzleloading firearm, wherein the method includes providing a preloaded sabot. The sabot having an extended casing area to receive propellant charge, and a further top portion slotted extension for receiving a projectile, is presented in a firearm barrel. The sabot may secure the propellant charge by receiving an insertable cap. A breech plug is inserted into the breech end of the barrel. The breech plug is configured to effectuate a puncture to the breech end of the sabot upon insertion of the sabot. The puncture being in the lower portion of the sabot, such that gasses released from a primer cap located at the opposite end of the breech plug flow through a capillary tube axially placed in the breech plug, and exit into the lower portion of the preloaded sabot, which ignites the propellant charge, and accelerates the sabot system out of the barrel.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A breech plug for a muzzleloader firearm, the breech plug adapted for use with ammunition having a preloaded sabot, the breech plug comprising:

a cylindrical body extending from a breech end to a muzzle end along an axial or longitudinal axis, at least a portion of the cylindrical body having a threaded outer surface for removable installation of said breech plug with a corresponding complementary threaded connection of the firearm and for securing said breech plug in a stationary position during triggering of the firearm;

a nose portion at a muzzle end of the breech plug extending along the longitudinal axis beyond said cylindrical body muzzle end;

a cavity or pocket at a breech end of the breech plug for receiving a primer cap;

an internal passage for transporting gas from the primer cap into the barrel through the nose portion of the breech plug, upon firing of the muzzleloader firearm;

the nose portion having a piercing component for puncturing the preloaded sabot upon final placement of the preloaded sabot into the barrel, said piercing component forming a wedge-shaped structure with a sharp straight edge, or cup-shaped structure having a sharp circumferential edge, or a pin-shaped structure, such that when the muzzleloader firearm is loaded, said piercing component pierces said preloaded sabot, and when the muzzleloader firearm is fired, hot gas from the primer cap is transported through the breech plug, into the punctured preloaded sabot, where a propellant charge is ignited.

2. The breech plug for a muzzleloader firearm of claim 1, wherein the wedge-shaped structure having at least two angled faces coming together at a top surface and forming a straight edge with a portion of the internal passage passing therethrough.

3. The breech plug for a muzzleloader firearm of claim 1, wherein the piercing component includes a pin-shaped structure for puncturing the preloaded sabot, the pin-shaped structure having a portion of the internal passage passing therethrough.

4. The breech plug for a muzzleloader firearm of claim 1, wherein the cup-shaped structure includes a cup-shaped structure extending with the circumferential sharp edge in a direction of the barrel muzzle end, the cup-shaped structure having narrow or sharp edges at a periphery for piercing the preloaded sabot, the cap-shaped structure having a portion of the internal passage passing therethrough.

5. A breech plug for a firearm comprising:

a body extending from a breech end to a muzzle end along a longitudinal axis;

at least a portion of said body having threaded outer surface for removable installation of said breech plug with a corresponding complementary threaded connection of the firearm for securing said breech plug in a stationary position during triggering of the firearm;

a nose portion at a muzzle end of the breech plug extending along the longitudinal axis beyond said body muzzle end;

an internal borehole through at least a portion of the breech plug for transporting gas from a primer cap, upon firing of the firearm, into a barrel;

the breech plug including a protrusion forming a wedge-shaped structure with a sharp straight edge, or cup-shaped structure having a sharp circumferential edge, or a pin-shaped structure, for puncturing or piercing ammunition upon placement of the ammunition into the barrel, said ammunition having a casing or sabot, such that when the firearm is fired, hot gas from the primer cap is transported through the breech plug internal borehole into the punctured or pierced ammunition casing or sabot.

6. The breech plug of claim 5, wherein the protrusion includes a formed pointed or sharp edged piercing top surface for puncturing the ammunition casing or sabot.

7. The breech plug of claim 6 wherein said wedge-shaped structure having at least two angled faces coming together at a top surface and forming an exposed straight edge.

8. The breech plug of claim 6, wherein said protrusion extends a portion of the internal borehole through said formed pointed or sharp-edged piercing element.

9. The breech plug of claim 5, wherein the protrusion includes a pin-shaped or arrow-shaped structure.

10. The breech plug of claim 9, wherein the pin-shaped or arrow-shaped structure extends a portion of the internal borehole.

11. The breech plug of claim 5, wherein the protrusion includes said cup-shaped structure or at least one segmented portion thereof extending in a direction of the barrel muzzle end, having narrow or sharp edges.

12. The breech plug of claim 11, wherein the cup-shaped structure includes a portion of the internal borehole passing therethrough.

* * * * *